US007732740B2

(12) United States Patent
Hsien Shan

(10) Patent No.: US 7,732,740 B2
(45) Date of Patent: Jun. 8, 2010

(54) CASING FOR ELECTRIC STOVES

(76) Inventor: Sung Hsien Shan, No. 40, Jhong jheng Road, Jhong jheng District, Keelung City, 202 (TW)

( * ) Notice: Subject to any disclaimer, the term of this patent is extended or adjusted under 35 U.S.C. 154(b) by 496 days.

(21) Appl. No.: 11/790,292

(22) Filed: Apr. 24, 2007

(65) Prior Publication Data

US 2008/0264928 A1 Oct. 30, 2008

(51) Int. Cl.
*H05B 3/68* (2006.01)

(52) U.S. Cl. ..... 219/452.11; 219/465.1

(58) Field of Classification Search ... 219/443.1–468.2, 219/620–624; 126/39 B, 39 BA, 39 H, 39 J, 126/90 A, 92 A, 92 B
See application file for complete search history.

(56) References Cited

U.S. PATENT DOCUMENTS 3,870,862 A * 3/1975 Doner ..... 219/452.12
4,191,875 A * 3/1980 Cunningham ..... 219/623
4,216,370 A * 8/1980 Charvat ..... 219/452.11
5,446,268 A * 8/1995 Chen ..... 219/623

* cited by examiner

*Primary Examiner*—Sang Y Paik
(74) *Attorney, Agent, or Firm*—Muncy, Geissler, Olds & Lowe, PLLC

(57) ABSTRACT

A casing for electric stoves includes an annular frame and a bottom board that are detachably coupled through a plurality of connectors. The frame has at least one lateral side with an air convection means located thereon. The bottom board has an upper surface with a heat control means installed thereon. Through the detachable bottom board, the entire electric stoves need not to be disassembled or removed when malfunction occurs and needs repair. By separating the bottom board from the frame, the electric link between the heat control means and the electric stove can be disconnected to replace the heat control means. Thus the malfunction can be fixed quickly, and interruption or delay of cooking that might otherwise happen can be prevented.

15 Claims, 4 Drawing Sheets

CASING FOR ELECTRIC STOVES

BACKGROUND OF THE INVENTION

1. Field of the Invention

The present invention is related to a casing for electric stoves and particularly to a casing for wedged or non-wedged type of electric stoves which has a detachable bottom board separated from the casing. In the event of malfunction, replacing a heat control means on the bottom board can quickly fix the malfunction without interrupting or delaying cooking.

2. Description of the Prior Art

Electric stoves are cooking instruments that do cooking through electric energy. Electromagnetic stoves heat the bottom of an iron cookware through electromagnetic agitation for cooking while electric stoves directly heat a cookware through a heater.

The electric stoves can be divided into single stove type or multi-stove type depending on the number of stoves. The single stove type usually can be moved freely. The multi-stove type usually is embedded in a counter top of the kitchen. Both type of the electric stoves have at least one heater and a heat control means located in a casing. The casing has a top surface covered by a glass or ceramic face panel. to serves as a holding surface and aesthetic counter top between the electric stove and the cookware.

The casing usually has four sides and a bottom that are combined into one inseparable piece. The heater and heat control means are fastened to the bottom of the casing. In the event of a malfunction for the single stove or multi-stove type, the face panel and heater would have to be removed from the upper side in this order and possible malfunction spots in the heat control means are then tested through an electric inspection instrument. If the source of malfunction cannot be determined on-site, the entire set has to be returned to factory for further inspection followed by repairs or replacement of elements. For the wedged type electric stove, removal (removing) of the electric stove forms a big and unsightly opening on the kitchen counter top. Moreover, either the single stove or multi-stove type, cooking cannot be done during repairing. Furthermore, (And) the duration of repair time is often unpredictable.

SUMMARY OF THE INVENTION

In view of the aforesaid problems occurred to the conventional electric stoves, the present invention aims to provide a casing for electric stoves that has a detachable bottom board which can be rapidly removed from the casing in the event of malfunction. By replacing the heat control means on the bottom board quickly repairs the malfunction problem without interrupting or delaying cooking. In addition (Moreover), there is no need to remove the entire casing from the kitchen counter top so that no unsightly opening would be left on the kitchen counter top.

To achieve the foregoing object, the casing of the invention includes an annular frame with a bottom board to hold a heater and a heat control means which is connected to the heater through an electric link. The frame has a top surface with a face panel located thereon. The heater installed on the frame is close to the bottom of the face panel. The invention has the following features: the frame has at least one lateral side with a means for air convection located thereon; the bottom board is coupled with the frame in a detachable manner; the heat control means is installed on an upper surface of the bottom board in a detachable manner; and a plurality of connectors are provided to fasten the bottom board to the bottom of the frame.

By means of the construction set forth above, the bottom board can be fully separated from the frame; or the bottom board can be hinged on the frame at one lateral side while other lateral sides can be lifted and separated from the frame except the hinged side.

In one aspect, the casing houses at least one assembly consisting of the heater and heat control means. For multiple sets of assemblies, they can be located on the surface of the face panel in a matrix fashion like a conventional multi-stove electric stove.

In another aspect, the bottom board may have a U-shaped trough formed on the upper surface to allow the heat control means to be coupled thereon quickly.

In the event of the electric stove malfunctions, the bottom board can be separated from the frame, and the heat control means can be removed from the bottom board for replacement. Thus the malfunction can be fixed quickly without interrupting or delaying cooking.

The foregoing, as well as additional objects, features and advantages of the invention will be more readily apparent from the following detailed description, which proceeds with reference to the accompanying drawings.

BRIEF DESCRIPTION OF THE DRAWINGS

FIG. 2A showing a fully separating condition, and FIG. 2B showing the bottom board having one lateral side hinged on the bottom of the frame while other lateral sides being fully separated from the bottom of the frame.

FIG. 3A showing the connectors being located on at least one lateral side of the bottom board, and FIG. 3B showing the connectors being located on the bottom of the frame.

DESCRIPTION OF THE PREFERRED EMBODIMENTS

Figure 1:
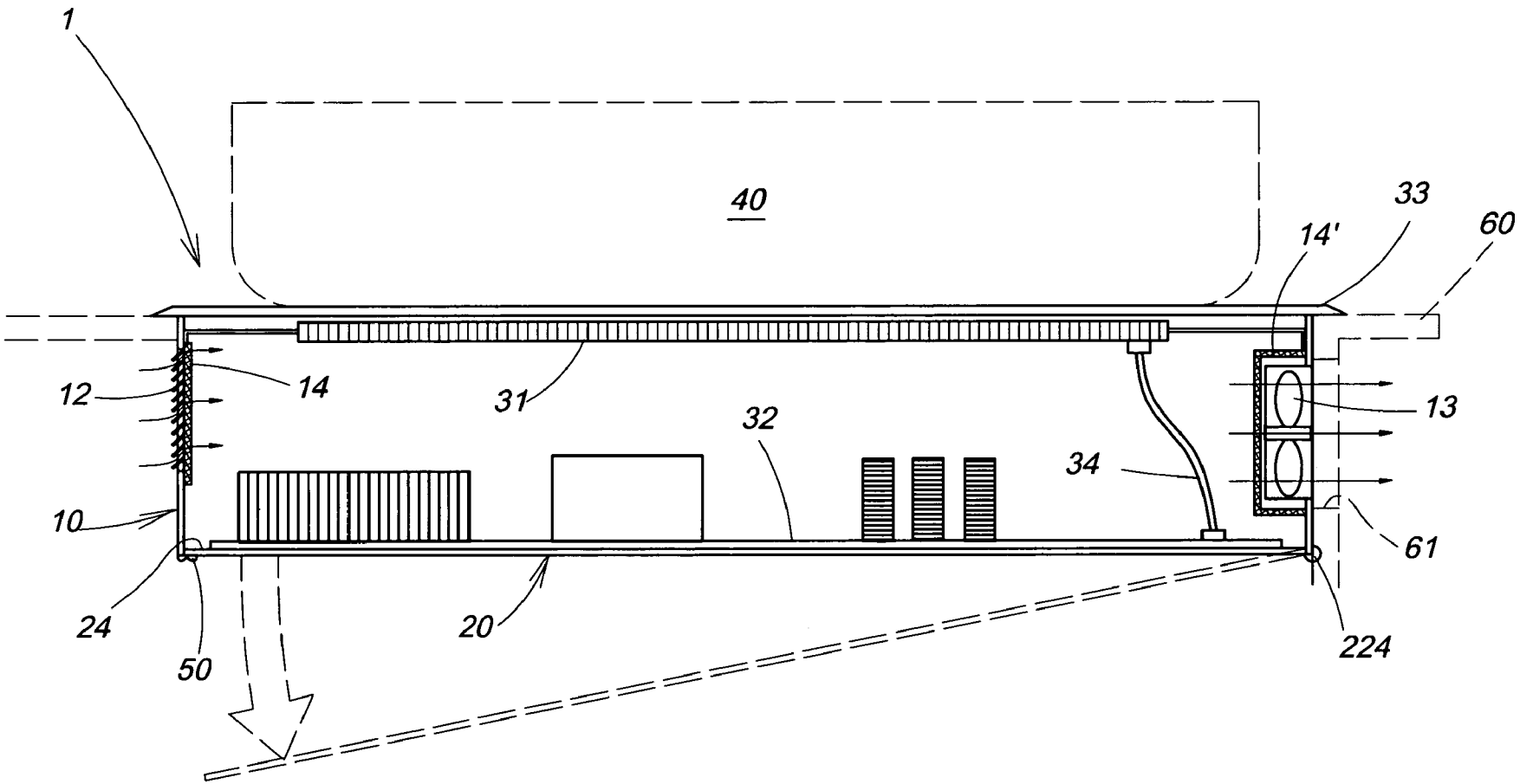
FIG. 1 is a sectional view of an embodiment of the casing of the invention adopted for a wedged type electric stove.

Refer to FIG. 1 for an embodiment of the casing 1 for an electric stove of the invention. It includes an annular frame 10 and a bottom board 20. The casing 1 houses a heater 31 and a heat control means 32 connecting to the heater 31 through an electric link 34. The heat control means 32 is known in the art, and may include a circuit board, a coil and other necessary control elements as shown in FIG. 1. The frame 10 has a top surface with a face panel 33 located thereon to serve as a counter top for holding a cookware 40 for cooking. The heater 31 is located on the frame 10 adjacent to the bottom of the face panel 33.

In one embodiment of the invention the frame 10 has at least one lateral side 11 with an air convection means located thereon to perform air convection as shown in FIG. 1. It may be a grid 12 or an air fan 13, or both located on different lateral sides 11 at the same time. When both exist at the different lateral sides they do not have to be located at corresponding positions. FIG. 1 shows a preferable location relationship, namely with the grid 12 and the air fan 13 located on two opposite lateral sides so that when heat in the frame 10 is dispelled through the air fan 13 cold air is channeled in through the grid 12.

In other embodiments the air fan 13 may also serve air suction and discharge function, then the grid 12 may be located on any lateral side without opposing the air fan 13 to achieve equal air convection effect.

In another embodiment of the invention the frame may also has a mesh 14 on the lateral side where the air convection means is located to prevent insects from entering the electric stove.

Figure 2A:
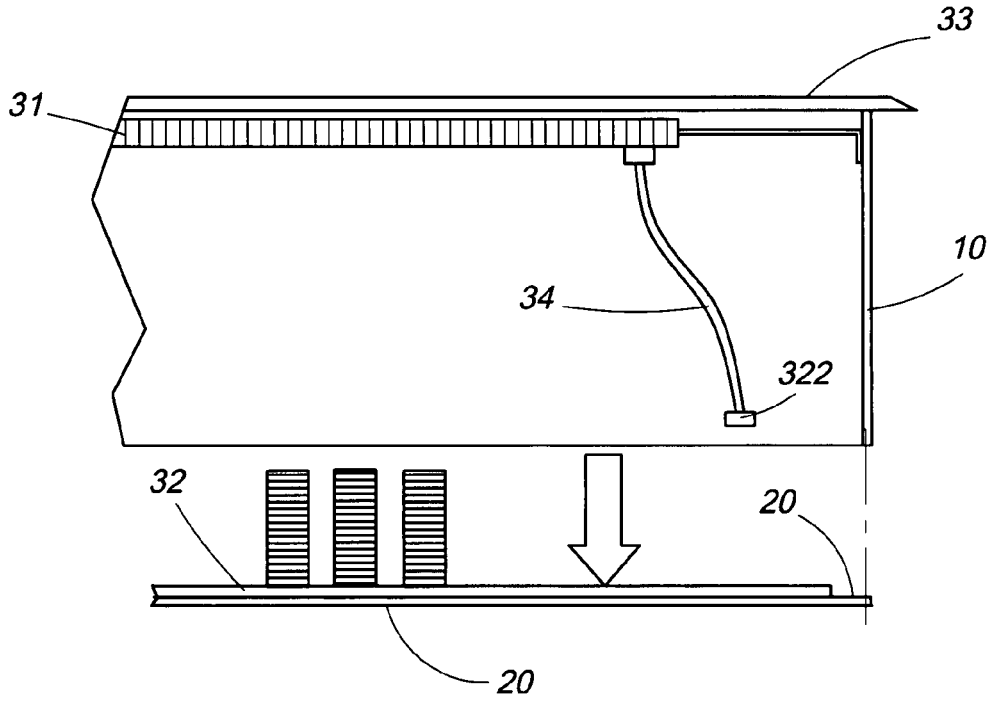
FIGS. 2A and 2B are schematic views of an embodiment of the casing of the invention with the bottom board separating from the frame.

In one aspect the bottom board 20 may be coupled with the frame 10 in a detachable manner. In one embodiment the bottom board 20 may be fully removed and separated from the bottom of the frame 10 as shown in FIG. 2A. In another embodiment the bottom board 22 has one lateral side 222 pivotally coupled with the frame 10 through a hinge 224 while other lateral sides 226 are coupled with the frame 10 in a detachable manner. In either condition mentioned above the heat control means 32 is installed on an upper surface 24 of the bottom board so that the heat control means 32 also is coupled with the frame 10 in a detachable manner as the bottom board does.

Figure 3A:
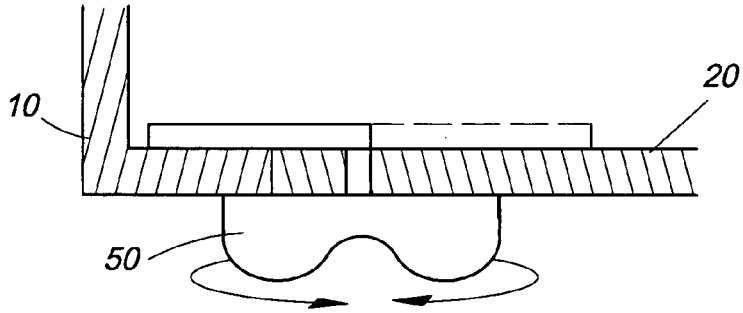
FIGS. 3A and 3B are schematic views of an embodiment of the casing of the invention with a plurality of connectors coupling the bottom board with the bottom of the frame.
Figure 3B:
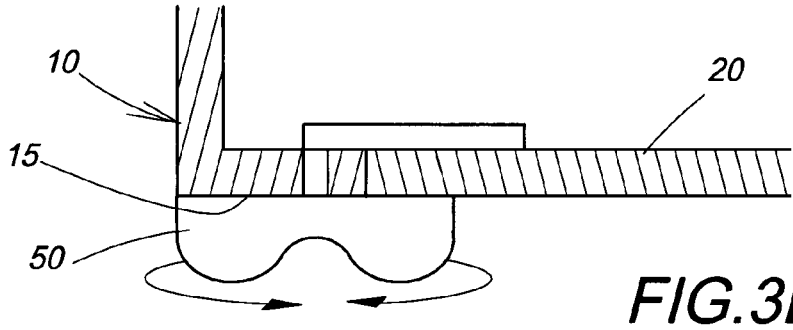

In another aspect the bottom board 20 has a plurality of connectors 50 to couple with the bottom of the frame. The connectors may be located on at least one lateral side of the bottom board 20 as an embodiment shown in FIG. 3A, or located on the bottom 15 of the frame 10 as shown in FIG. 3B. The connectors 50 may be any elements capable of movably connecting or separating two objects. FIGS. 3A and 3B show examples such as a rotary knob, door bolt or the like.

In another aspect, as the embodiment shown in FIG. 1, one lateral side of the bottom board 20 is pivotally coupled with the bottom of the frame 10 through the hinge 224, while other lateral sides or one side opposing the hinge 224 are coupled or separated from the frame 10 through the connectors 50.

Figure 2B:
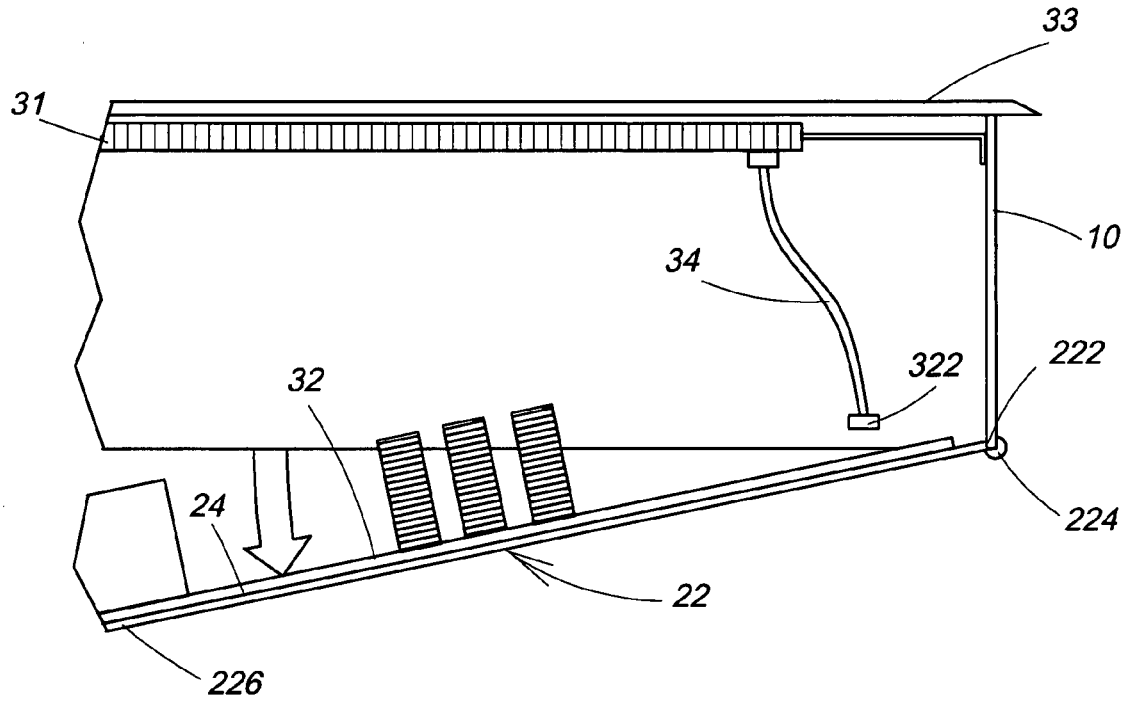
Figure 4:
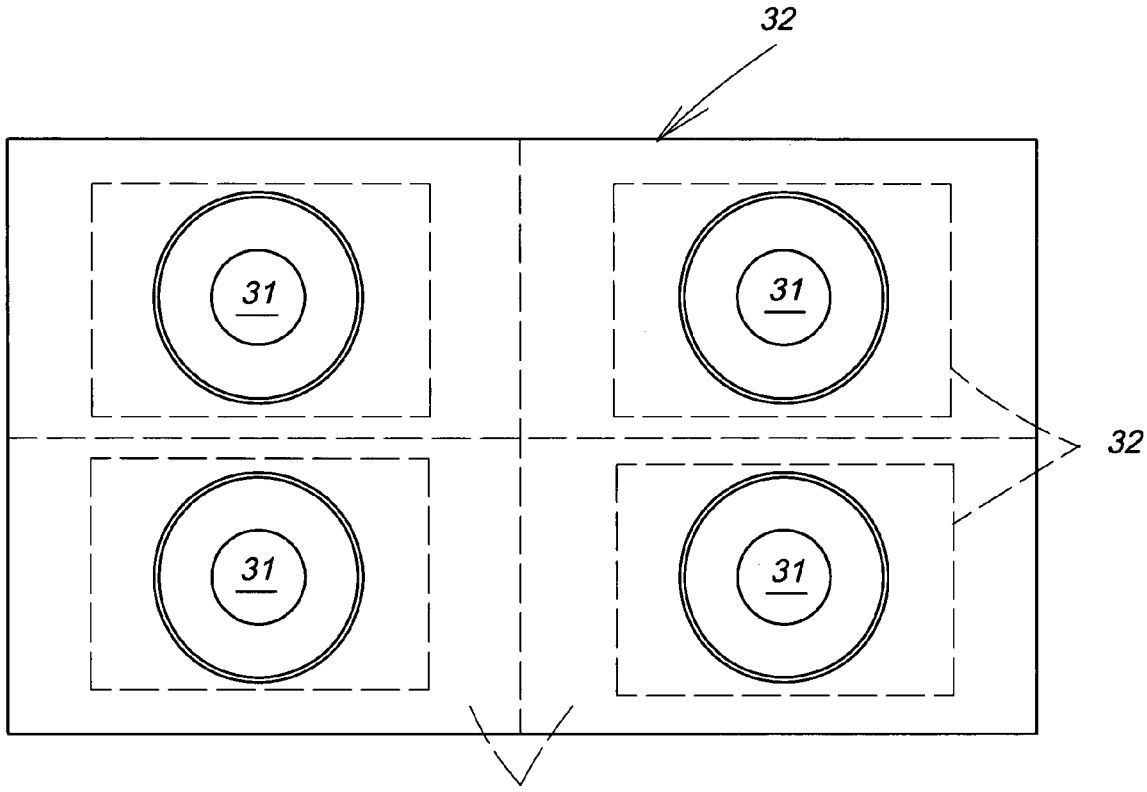
FIG. 4 is a schematic view of an embodiment of the casing of the invention housing a plurality of heaters and heat control means that are arranged on the face panel in a matrix fashion.

In another aspect, the casing contains at least one assembly consisting of the heater 31 and heat control means 32 that are arranged on the face panel 33 in a matrix fashion as shown in FIG. 4, or any other desired layouts. In an embodiment with multiple heaters 31 on the face panel 33 it is preferably to have one heater corresponding to one heat control means that are located on the detachable bottom board 20 as shown in FIG. 2B.

Figure 5:
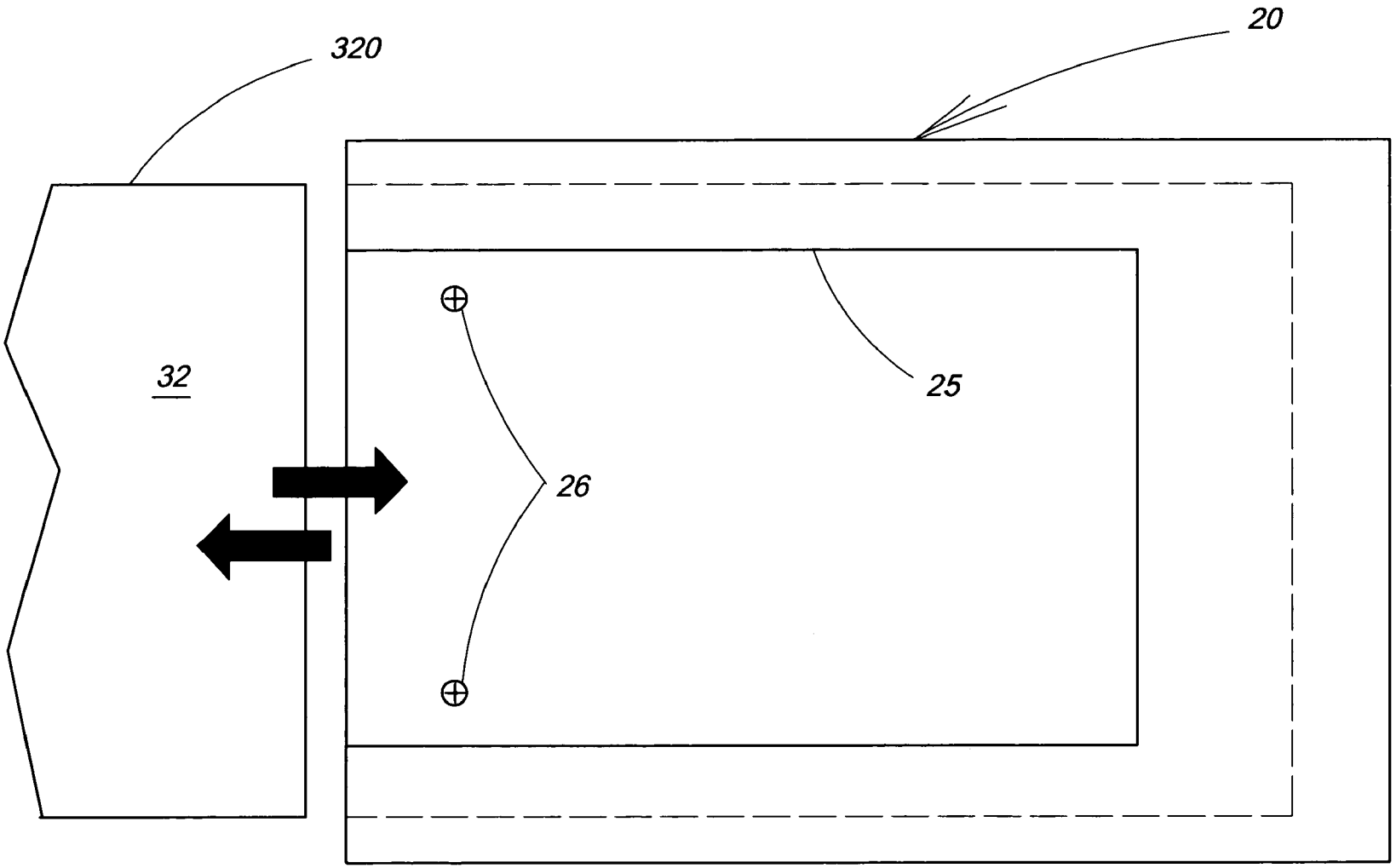
FIG. 5 is a top view of an embodiment of the casing of the invention with a U-shaped trough formed on the upper surface of the bottom board.

In another aspect the heat control means 32 may be installed quickly on the upper surface 24 of the bottom board 20 as shown in FIG. 1. The upper surface 24 may include a U-shaped trough 25 as shown in FIG. 5 so that the heat control means 32 may be rapidly inserted in the U-shaped trough 25 through an edge 320 thereof to facilitate installation or removal. To facilitate secured mounting of the heat control means onto the upper surface of the bottom board, one or more fastening element 26 such as a screw may be included after the heat control means has been inserted in the U-shaped trough to do fastening.

By means of the embodiments of the casing 1 set forth above, in the event that malfunctions occur the bottom board may be separated from the frame without removing the entire electric stove and sending to the factory for repairs. The heat control means 32 has an electric connection end 322 which may be disconnected to replace a new heat control means to fix the malfunction problem onsite. Thus interruption or delay of cooking can be prevented.

For the casing 1 of the wedged type electric stove the air fan 13 is preferably close to an ornamental outer panel 60 as shown in FIG. 1. The ornamental outer panel 60 has an opening 61 corresponding to the air fan 13 to improve air discharge and air convection efficiency.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

I claim:

1. A casing for electric stoves comprising an annular frame and a bottom board to house a heater and a heat control means which is connected to the heater through an electric link, the frame having a top surface covered by a face panel, the heater being located on the frame adjacent to the bottom of the face panel, wherein:

the frame has at least one lateral side which has an air convection means located thereon;

the bottom board is detachably coupled with the frame, and the heat control means is detachably installed on an upper surface of the bottom board; and the casing further has a plurality of connectors to couple the bottom board with the bottom of the frame;

wherein the upper surface of the bottom board has a U-shaped trough to allow the heat control means to be inserted rapidly and coupled thereon.

2. The casing for electric stoves of claim 1, wherein the air convection means is an air fan.

3. The casing for electric stoves of claim 1, wherein the lateral side of the frame where the air convection means is located further has a mesh to fend off insects.

4. The casing for electric stoves of claim 1, wherein the bottom board has a lateral side coupled with the bottom of frame through a hinge and other lateral sides detachably coupled with frame through the connectors.

5. The casing for electric stoves of claim 1, wherein the connectors are located on at least one lateral side of the bottom board.

6. The casing for electric stoves of claim 1, wherein the connectors are located on bottom of the frame.

7. The casing for electric stoves of claim 1, wherein the heater and the heat control means form at least one set of assembly arranged in a matrix fashion on the surface of the face panel.

8. The casing for electric stoves of claim 7, wherein each set of the assembly of the heater and the heat control means has a detachable bottom board.

9. The casing for electric stoves of claim 1, further having at least one fastening element to securely fasten the heat control means coupled on the U-shaped trough to the upper surface of the bottom board.

10. A casing for electric stoves comprising an annular frame and a bottom board to house a heater and a heat control means which is connected to the heater trough an electric link, the frame having a top surface covered by a face panel, the heater being located on the frame adjacent to the bottom of the face panel, wherein:

the frame has at least one lateral side which has an air convection means located thereon;

the bottom board is detachably coupled with the frame, and the heat control means is detachably installed on an upper surface of the bottom board;

the casing further has a plurality of connectors to couple the bottom board with the bottom of the frame;

wherein the heater and the heat control means form at least one set of assembly arranged in a matrix fashion on the surface of the face panel; and wherein each set of the assembly of the heater and the heat control means has a detachable bottom board.

11. The casing for electric stoves of claim 10, wherein the air convection means is an air fan.

12. The casing for electric stoves of claim 10, wherein the lateral side of the frame where the air convection means is located further has a mesh to fend off insects.

13. A casing for electric stoves comprising an annular frame and a bottom board to house a heater and a heat control means which is connected to the heater through an electric link, the frame having a top surface covered by a face panel, the heater being located on the frame adjacent to the bottom of the face panel, wherein:

the frame has at least one lateral side which has an air convection means located thereon;

the bottom board is detachably coupled with the frame, and the heat control means is detachably installed on an upper surface of the bottom board; and the casing further has a plurality of connectors to couple the bottom board with the bottom of the frame;

wherein the bottom board has a lateral side coupled with the bottom of frame through a hinge and other lateral sides detachably coupled with frame through the connectors.

14. The casing for electric stoves of claim 13, wherein the air convection means is an air fan.

15. The casing for electric stoves of claim 13, wherein the lateral side of the frame where the air convection means is located further has a mesh to fend off insects.

* * * * *